United States Patent [19]

Stauss

[11] Patent Number: 4,790,786

[45] Date of Patent: Dec. 13, 1988

[54] FACTORY FIXTURE FRAME FOR AN IN-PROCESS TENSION MASK COLOR CATHODE RAY TUBE

[75] Inventor: Paul Stauss, Chicago, Ill.

[73] Assignee: Zenith Elecronics Corporation, Glenview, Ill.

[21] Appl. No.: 51,896

[22] Filed: May 18, 1987

[51] Int. Cl.[4] ..... H01J 9/227

[52] U.S. Cl. ..... 445/68; 269/40; 269/254 R; 430/23; 24/462; 160/371

[58] Field of Search ..... 445/52, 30, 37, 68; 313/402, 407, 408; 430/23, 24; 269/40, 254 D, 254 R; 29/448; 140/108, 109; 24/462; 38/102.91; 160/371

[56] References Cited

U.S. PATENT DOCUMENTS

| | | | |
|---|---|---|---|
| 159,870 | 2/1875 | Webb | 269/254 D |
| 2,625,734 | 1/1953 | Law | 445/52 |
| 2,654,940 | 10/1953 | Law | 445/36 |
| 2,824,990 | 2/1958 | Haas | 313/402 |
| 2,867,028 | 1/1959 | Trost | 24/462 |
| 3,357,459 | 12/1967 | Cohen et al. | 140/109 X |
| 3,623,211 | 11/1971 | Zuhlke | 29/448 |
| 3,894,321 | 7/1975 | Moore | 313/402 X |
| 4,322,901 | 4/1982 | Spitzke | 38/102.91 X |
| 4,525,909 | 7/1985 | Newman | 38/102.91 X |
| 4,547,696 | 10/1985 | Strauss | 313/407 |
| 4,591,344 | 5/1986 | Palac | 445/30 |
| 4,593,224 | 1/1986 | Palac | 313/402 |
| 4,721,488 | 1/1988 | Dougherty et al. | 29/448 X |

OTHER PUBLICATIONS

Grimes et al., "Improvements in the RCA Three-Beam Shadow Mask Color Kinescope", IRE Jan. 1954, R583.6.

*Primary Examiner*—Kenneth J. Ramsey

[57] ABSTRACT

A reusable factory fixture frame is disclosed for use in the manufacture of a color cathode ray tube having a flat faceplate and a tensed foil shadow mask. The frame provides for mounting an in-process shadow mask during photoexposure of an in-process faceplate in a lighthouse. The frame comprises generally rectangular frame means and quick-release mechanical mask-retaining means for temporarily and removably supporting an in-process shadow mask in tension. The frame has at least first six-point indexing means on a first side for registration with complementary registration-affording means on an exposure lighthouse, and second six-point indexing means on a second, opposed side for registration with complementary registration-affording means on an in-process faceplate. As a result, the in-process shadow mask can be precisely registered and re-registered with the lighthouse and the in-process faceplate for the photoexposure of the in-process faceplate while retaining the in-process shadow mask in tension.

12 Claims, 7 Drawing Sheets

FACTORY FIXTURE FRAME FOR AN IN-PROCESS TENSION MASK COLOR CATHODE RAY TUBE

CROSS-REFERENCE TO RELATED APPLICATIONS AND PATENTS

This application is related to but in no way dependent upon copending applications Ser. No. 583,003 now U.S. Pat. No. 4,721,879; Ser. No. 646,861 now U.S. Pat. No. 4,614,892; Ser. No. 758,174 now U.S. Pat. No. 4,713,034; Ser. No. 831,696 now U.S. Pat. No. 4,721,488; Ser. No. 894,984 now U.S. Pat. No. 4,739,412; Ser. No. 947,727 now U.S. Pat. No. 4,739,215; Ser. No. 140,019 filed Dec. 31, 1987; Ser. No. 131,968 filed Dec. 11, 1987; Ser. No. 60,135 filed June 9, 1987; Ser. No. 58,095 filed June 4, 1987; and U.S. Pat. Nos. 3,894,321; 4,069,567; 4,547,696; 4,591,344; 4,593,224; 4,595,857; and 4,656,388, all of common ownership herewith.

SPECIFICATION

This specification includes an account of the background of the invention, a description of the best mode presently contemplated for carrying out the invention, and appended claims.

BACKGROUND OF THE INVENTION

1. Field of the Invention

This invention relates to color cathode ray picture tubes, and is addressed specifically to improved factory means and processes for the manufacture of tubes having a tensed foil shadow mask. Color tubes of various types that have a tension foil mask can be manufactured by the process, including those used in home entertainment television receivers. The process according to the invention is particularly valuable in the manufacture of medium-resolution, high-resolution, and ultrahigh resolution tubes intended for color monitors.

The use of the foil-type flat tensed mask and flat faceplate provides many benefits in comparison to the conventional domed shadow mask and correlatively curved faceplate. Chief among these is a greater power-handling capability which makes possible as much as a three-fold increase in brightness. The conventional curved shadow mask, which is not under tension, tends to "dome" in picture areas of high brightness where the intensity of the electron beam bombardment is greatest. Color impurities result as the mask moves closer to the faceplate and as the beam-passing apertures move out of registration with their associated phosphor elements on the faceplate. The tensed mask when heated distorts in a manner quite different from the conventional mask. If the entire mask is heated uniformly, there is no doming and no distortion until tension is completely lost; just before that point, wrinkling may occur in the corners. If only portions of the mask are heated, those portions expand, and the unheated portions contract, resulting in displacements within the plane of the mask; i.e., the mask remains flat.

The tensed foil shadow mask is a part of the cathode ray tube front assembly, and is located in close adjacency to the faceplate. The front assembly comprises the faceplate with its screen which consists of deposits of light-emitting phosphors, a shadow mask, and support means for the mask. As used herein, the term "shadow mask" means an apertured metallic foil which may, by way of example, be about 0.001 inch or less in thickness. The mask must be supported under high tension a predetermined distance from the inner surface of the cathode ray tube faceplate; this distance is known as the "Q-distance." As is well known in the art, the shadow mask acts as a color-selection electrode, or parallax barrier, which ensures that each of the three electron beams lands only on its assigned phosphor deposits.

The conventional process of depositing patterns of color phosphor elements on the screening surface of a color picture tube faceplate utilizes the well-known photoscreening process. A shadow mask, which in effect functions as a perforated optical stencil, is used in conjunction with a light source to expose in successive steps, three discrete lightsensitive photoresist patterns on the screening surface. The shadow mask is typically "mated" to each faceplate; that is, the same mask is used in the production of a specific tube throughout the production process, and is permanently installed in the tube in final assembly. At least four engagements and four disengagements of the mask, as well as six exposures, are required in the standard screening process. In certain processes, a "master" may be used for exposing the photoresist patterns in lieu of the mated shadow mask.

2. Prior Art

There have been a number of disclosures of tensed foil masks and means for applying tension to the mask and retaining the mask under tension. Typical of these is the disclosure of Law in U.S. Pat. No. 2,625,734 which addresses the construction of a taught, planar foraminous mask. A foil mask blank is loosely mounted in a two-section frame, and the mask is expanded by the hot-blocking process. Machine screws peripheral to the frame provide for clamping the mask tightly in the frame when the mask is in its expanded state. The mask becomes tensed upon cooling as it is restrained from returning to its former dimensions by its captivation by the frame. The frame with the mask enclosed is mounted with the phosphor-bearing screen as a unitary assembly adjacent to the inner surface of the faceplate. Law in U.S. Pat. No. 2,654,940 also discloses means for stretching and captivating by frames masks formed from wire mesh.

U.S. Pat. No. 3,894,321 to Moore, of common ownership herewith, is directed to a method for processing a color cathode ray tube faceplate in conjunction with a thin foil tension shadow mask. A frame screw-clamp supports a tensed mask during lighthouse exposure of an associated screen. The faceplate is registered with the mask support frame by means of three alignment posts which extend from the lighthouse, and against which the frame and the faceplate are both biased by gravity. The faceplate and frame, being both referenced to the three lighthouse posts, are thereby referenced to each other.

In U.S. Pat. No. 4,591,344 to Palac, of common ownership herewith, a method of making a color cathode ray tube is disclosed in which a frame on which a shadow mask is stretched has indexing means cooperable with registration-affording means on a faceplate. The assembly provides for multiple registered matings of the faceplate and mask during photoscreening operations. A photographic plate is used in a process for applying the phosphor elements to the faceplate screening surface to provide an interchangeable mask system; this in lieu of the more common method of using a shadow mask permanently mated with a faceplate, and which serves as an optical stencil during the photoscreening process. The sealing areas of the faceplate and the frame are joined in a final assembly operation such that the frame becomes an integral constituent of the cathode ray tube.

A mask registration and supporting system for a cathode ray tube having a rounded faceplate with a skirt for attachment to a funnel is disclosed by Strauss in U.S. Pat. No. 4,547,696 of common ownership herewith. The skirt of the faceplate provides the necessary Q-distance between the mask and the screen. A frame dimensioned to enclose the screen comprises first and second space-apart surfaces. A tensed foil shadow mask has a peripheral portion bonded to a second surface of the frame. The frame is registered with the faceplate by ball-and-groove indexing means. The shadow mask is sandwiched between the frame and a stabilizing or stiffening member. Following final assembly, the frame is permanently fixed in place within the tube envelope between the sealing lands of the faceplate and a funnel, with a stiffening member projecting from the frame into the funnel.

In U.S. Pat. No. 4,593,224 to Palac, of common ownership herewith, there is disclosed a shadow mask mount in the shape of a rectangular frame for use in tensing an in-process shadow mask, and for temporarily supporting the mask while in tension. An apertured foil comprising the in-process mask is laid across the opening in the frame and is secured to the frame by brazing or welding. The coefficient of thermal expansion of the foil is preferably equal to or slightly less than that of the frame. A glass frame is also provided that consists of two identical rectangular members smaller in circumferential dimension than the metal frame. When joined into a single frame, the members are located between the tube faceplate and funnel to become an integral part of the tube envelope in final assembly. Each member of the glass frame has indexing means, one member for indent-detent registration with the faceplate, and the other for indent-detent registration with the funnel. Following the application of a layer of devitrifying cement in paste form to the facing surfaces of the two members, the mask, held in the metal frame, is sandwiched between the two members. As the assembly is heated, the expansion of the mask is taken up by screw means attached to the metal frame which press against the peripheries of the members. Upon cooling of the assembly, the coefficient of thermal expansion of the mask, being greater than that of the glass, results in the mask being held permanently in tension by the glass frame through the medium of the frit cement, which has become solidified by the heat. The portion of the mask that projects beyond the periphery of the glass frame is severed to release the metal frame. The glass frame with its captivated mask is then mounted on a lighthouse for photoscreening the faceplate, with registration with the lighthouse and faceplate provided by the indent-detent means described.

In referent U.S. Pat. No. 4,721,488 of common ownership herewith, there is disclosed an apparatus for tensing a foil shadow mask. The apparatus comprises a pedestal having registration-affording means, and a tensing structure which includes a fixture comprising a pair of collars for clamping the edge of a foil to support and maintain the foil in a taut condition. An anvil is provided for engaging a peripheral portion of the clamped foil to induce deflection of the foil, and thereby, a predetermined tension in the foil. Following a photoscreening process, the mask is secured to shadow mask supports extending from the faceplate by welding.

In a journal article, there is described means for mounting a flat tensed mask on a frame for use in a color cathode ray tube having a circular faceplate with a curved viewing surface. In one embodiment, the mask, which is also circular, is described as being welded to a circular frame comprised of a ⅛ inch steel section. The frame with captivated mask is mounted in spaced relationship to a phosphor-dot plate, and the combination is assembled into the tube as a package located adjacent to the faceplate. ("Improvements in the RCA ThreeBeam Shadow Mask Color Kinescope," by Grimes et al. The IRE, January 1954; decimal classification R583.6.)

OBJECTS OF THE INVENTION

It is a general object of this invention to provide means to facilitate the manufacture of color cathode ray tubes having a tensed foil shadow mask.

It is an object of this invention to provide improved fixturing means that will facilitate the manufacture of color cathode ray tubes having a tensed foil shadow mask.

It is an object of this invention to provide improved fixturing means for use in manufacturing an in-process assembly comprising a tensed foil in-process shadow mask and a flat faceplate.

It is another object of the invention to provide a factory fixture frame that is capable of highly precise and repeatable two-sided registration with a lighthouse and a faceplate during faceplate photoscreening, and precise registration with a mask-welding and severing machine.

It is yet another object of the invention to provide a factory fixture frame which is rigid in construction, reusable, and relatively light in weight for easy handling.

It is still another object to provide a factory fixture frame including tensed foil in-process shadow mask clamping means for quickly and securely clamping and retaining a shadow mask under high tension without damage to the mask.

BRIEF DESCRIPTION OF THE DRAWINGS

The features of the present invention which are believed to be novel are set forth with particularity in the appended claims. The invention, together with further objects and advantages thereof, may best be understood by reference to the following description taken in conjunction with the accompanying drawings (not to scale), in the several figures of which like reference numerals identify like elements, and in which:

DESCRIPTION OF THE PREFERRED EMBODIMENT

To facilitate understanding of the factory fixture frame and its relation to the process of manufacturing a tensed mask cathode ray tube, a brief description of a tube and its components is provided in following paragraphs.

Figure 1:
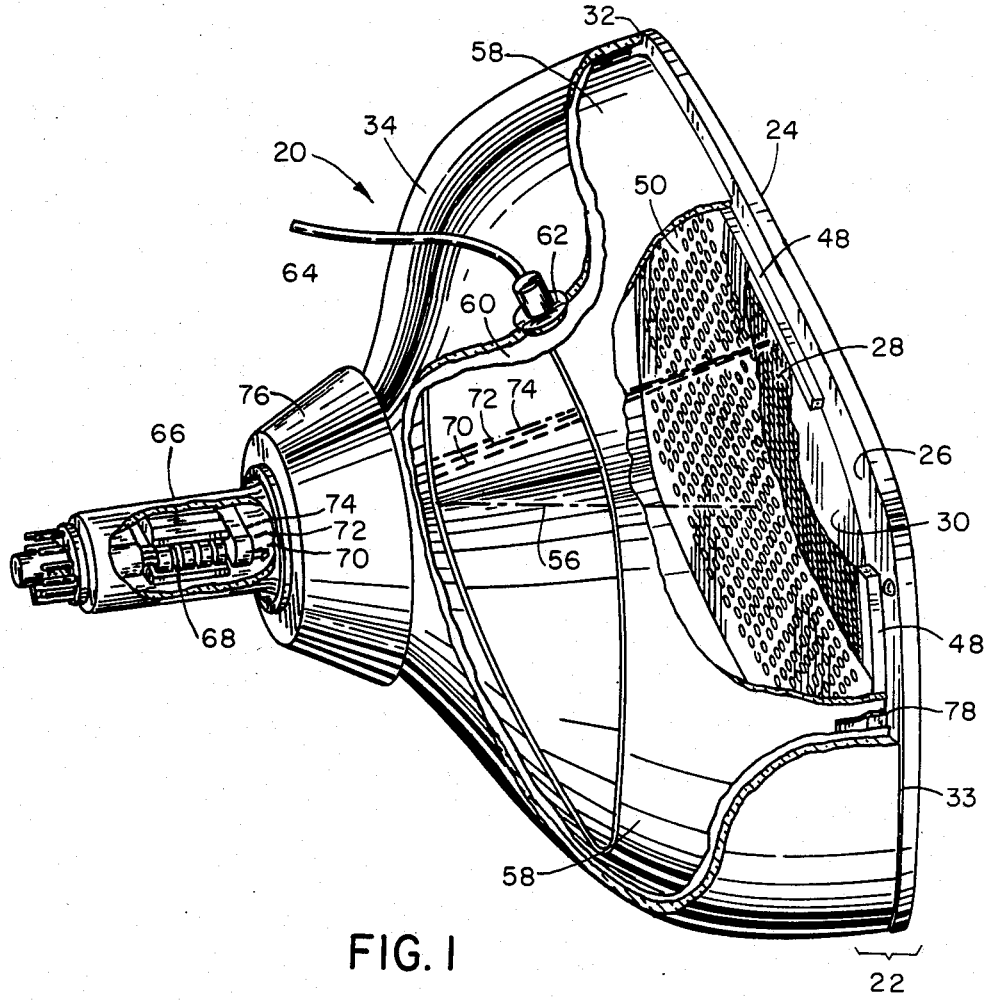
FIG. 1 is a side view in perspective of a color cathode ray tube having a flat faceplate and a tensed foil shadow mask, with cut-away sections that indicate the location and relation of the faceplate and shadow mask to other major tube components.

A color cathode ray tube 20 having a tensed foil shadow mask is shown by FIG. 1. The front assembly 22 of tube 20 includes a faceplate 24. On the inner surface 26 of face-plate 24—known as the "screening surface"—is indicated as being deposited a phosphor screen 28. A film of aluminum 30 is indicated as covering the screen 28. The peripheral sealing area 32 of faceplate 24 is depicted as being attached to the peripheral sealing area 33 of a funnel 34.

Front assembly 22 includes a shadow mask support structure 48 for mounting a metal foil shadow mask 50 which is secured to support structure 48 in tension. The anterior-posterior axis of tube 20 is indicated by reference number 56. A magnetic shield 58 is shown as being enclosed within funnel 34. High voltage for tube operation is indicated as being applied to a conductive coating 60 on the inner surface of funnel 32 by way of an anode button 62 connected in turn to a high-voltage conductor 64.

The neck 66 of tube 20 is represented as enclosing an in-line electron gun 68, depicted as providing three discrete in-line electron beams 70, 72 and 74 for exciting respective red-light-emitting, green-light-emitting, and blue-light-emitting phosphor elements on screen 28. Yoke 76 receives scanning signals and provides for the scanning of beams 70, 72 and 74 across screen 28. A contact spring 78 provides an electrical path between the funnel coating 60 and mask support structure 48.

The factory fixture frame according to the invention provides for the high precision in the registration and reregistration of a foil in-process shadow mask with a faceplate during manufacture. Absent the requisite precision, an error in registration of as little as 0.0002 inch can result in color impurities. Mask 50 typically may have about 1,700,000 apertures, and the resulting screen 28, after photoscreening by means of the factory fixture frame according to the invention, will have three times as many discrete phosphor deposits thereon. There is an absolute minimum of tolerance in registration at any stage of the production process.

Figure 2:
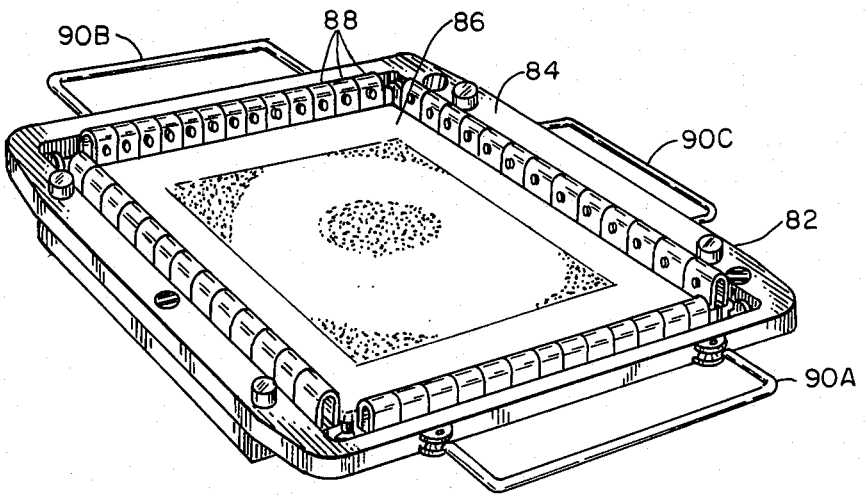
FIG. 2 is an oblique view in perspective of a factory fixture frame according to the invention with an in-process shadow mask mounted in tension therein.

A resuable factory fixture frame 82 according to the invention is shown in FIG. 2; a first side 84 of frame 82 is indicated. The frame 82 is intended for use in the manufacture of a color cathode ray tube of the type shown by FIG. 1, which is noted as having a flat faceplate and a tensed foil shadow mask. Factory fixture frame 82 provides for mounting an in-process shadow mask during photoexposure of an in-process faceplate in a lighthouse, and serves as a fixture for the process of welding and severing the in-process mask, as will be described. As depicted in FIG. 2, reusable factory fixture frame 82 comprises a generally rectangular frame means and quick-release mechanical mask-retaining means for temporarily and removably supporting in-process shadow mask 86 in tension. Frame 82 is indicated as supporting shadow mask 86 in tension by means of mechanical mask-retaining means 88. Factory fixture frame 82 provides for the cementless and weldless quick-retention of in-process shadow mask 86 out of the plane of mask 86.

Figure 3:
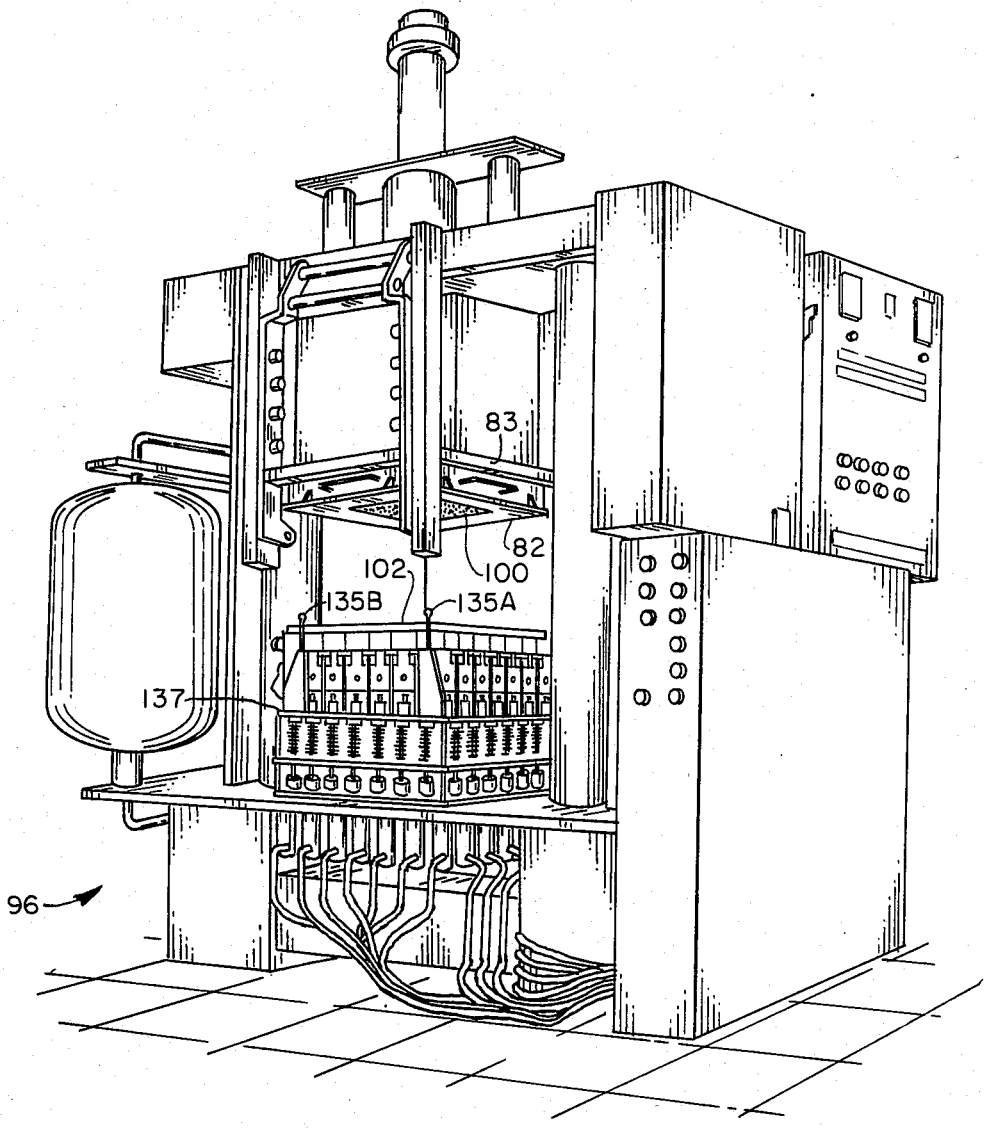
FIG. 3 is a view in elevation and in perspective of a mask tensing-clamping machine for receiving a factory fixture frame according to the invention.

The factory fixture frame 82 will be noted as having handles 90A, 90B and 90C for convenience in handling during manufacture. Handles 90A and 90B provide for lifting the frame, and handle 90C provides for inserting and removing the factory fixture frame 82 from the mask tensing-clamping machine 96 depicted in FIG. 3. The mask tensing-clamping machine 96 provides for receiving the factory fixture frame 82, which is loaded into the mask tensing-clamping machine 96 by an operator using the handles described; the factory fixture frame 82 is indicated in FIG. 3 as being mounted in machine 96, and ready to tense and clamp an in-process shadow mask. Machine 96 is indicated as having an upper platen 100 and a lower platen 102. The platens are heated to provide for expansion of the mask blank prior to the clamping operation.

Figure 4:
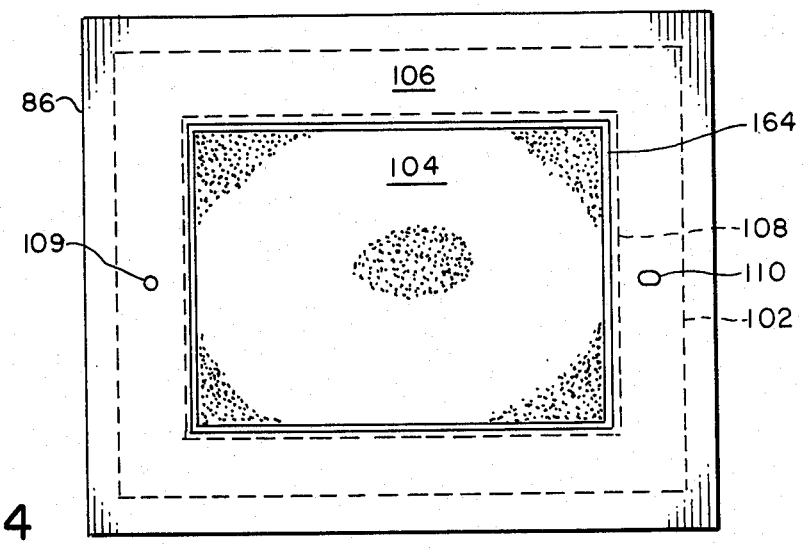
FIG. 4 is a plan view of an in-process shadow mask.
Figure 5:
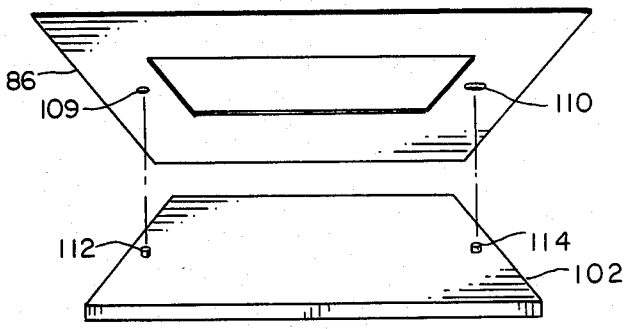
FIG. 5 is a perspective view that depicts schematically the mounting of an in-process shadow mask on a platen.

An in-process shadow mask is depicted in FIG. 4. Inprocess mask 86 comprises a center field 104 of apertures intended for the color selection function in the completed tube. Center field 104 is indicated as being enclosed by a frame 106 of unperforated metal; this frame is trimmed off in a later operation at trim line 108, indicated by the dash line, by means that will be described. In-process mask 86 is indicated as having a round perforation 109 in frame 106, and an elongated perforation 110 opposite. As depicted in FIG. 5, the perforations 109 and 110 provide for registering the in-process mask 86 with respective pins 112 and 114 that project from lower platen 102. The elongated perforation 110 provides tolerance for the expansion of the in-process mask resulting from its contact with the heated platens 100 and 102, an expansion that is on the order of 0.030 inch.

When the in-process mask 86 is fully expanded by the heat of upper and lower platens 100 and 102, the mask is clamped, and the platens are withdrawn. The mask tenses as it cools, and it is held in tension by the clamping means 88 that are a component of factory fixture frame 82, as will be described.

Figure 6:
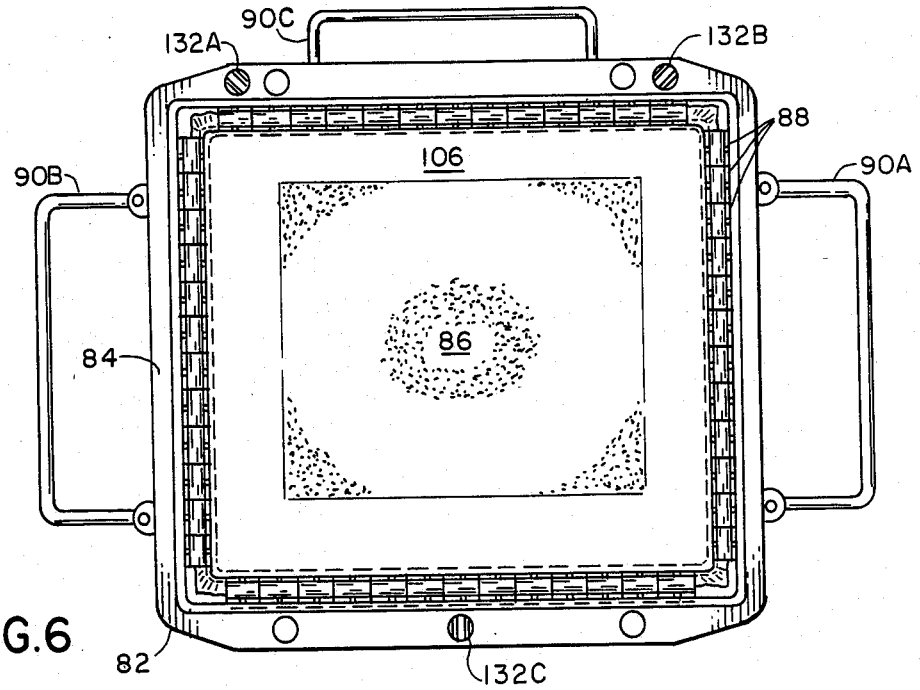
FIG. 6 is a plan view of a first side of a factory fixture frame according to the invention and showing details of indexing means.
Figure 7:
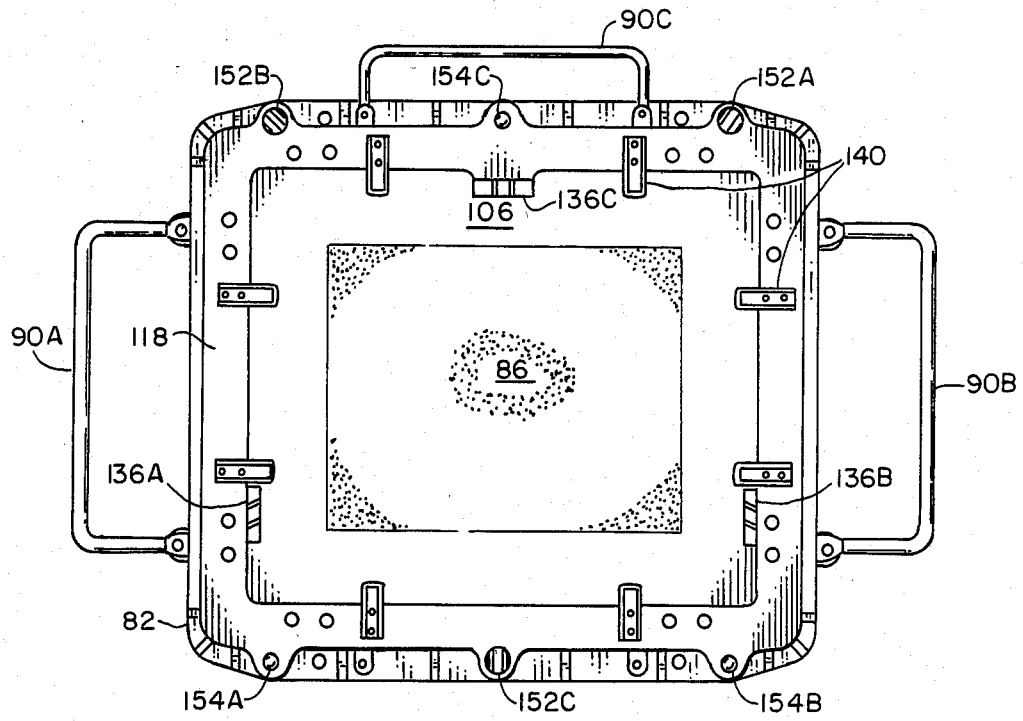
FIG. 7 is a view similar to the FIG. 6 view, but showing a second side of a factory fixture frame according to the invention, and showing additional details of indexing means.
Figure 8:
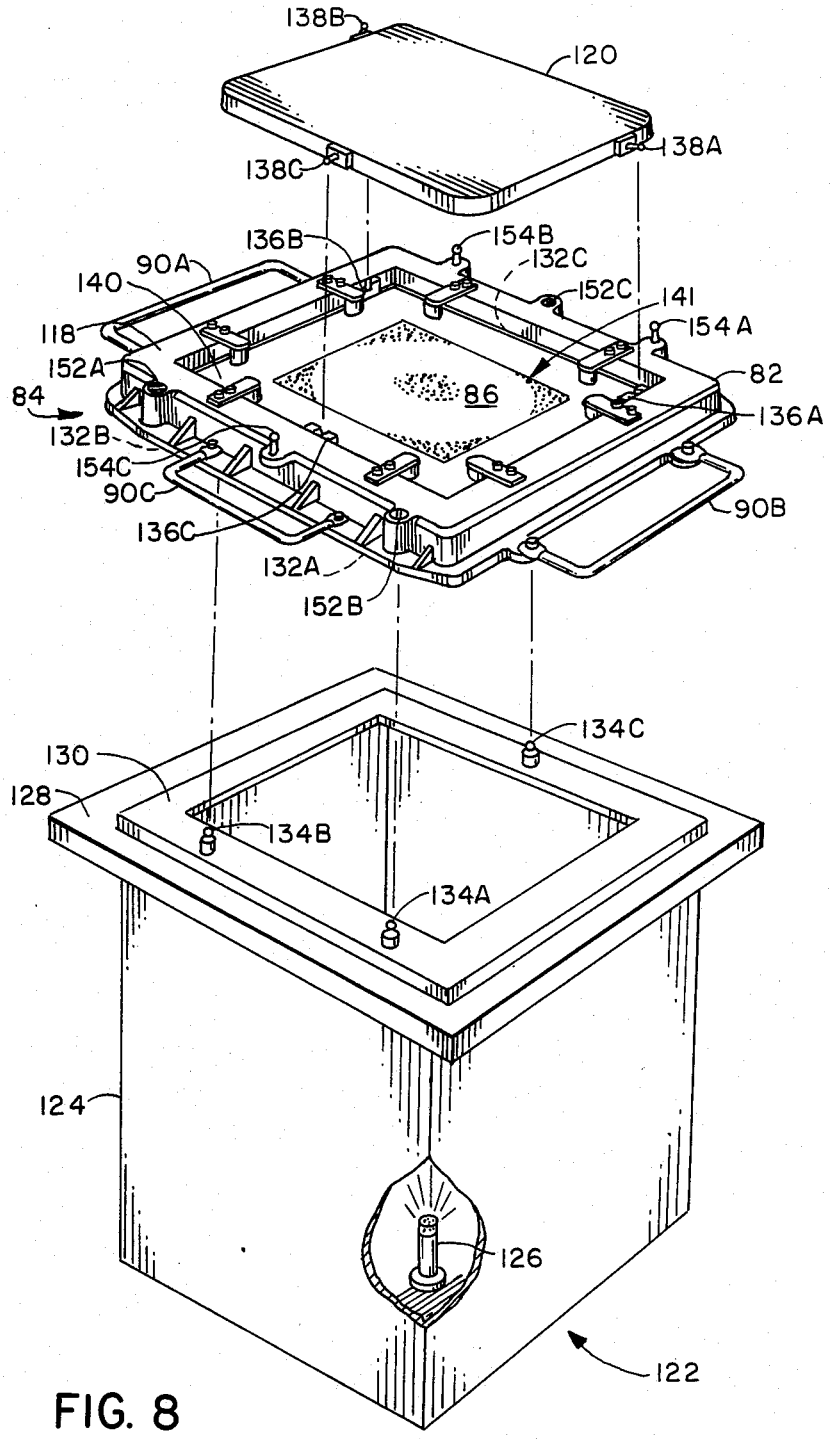
FIG. 8 is a perspective view of a photoexposure lighthouse with the base partly cut away, and with the factory fixture frame according to the invention and an in-process faceplate indicated as being exploded therefrom.
Figure 10:
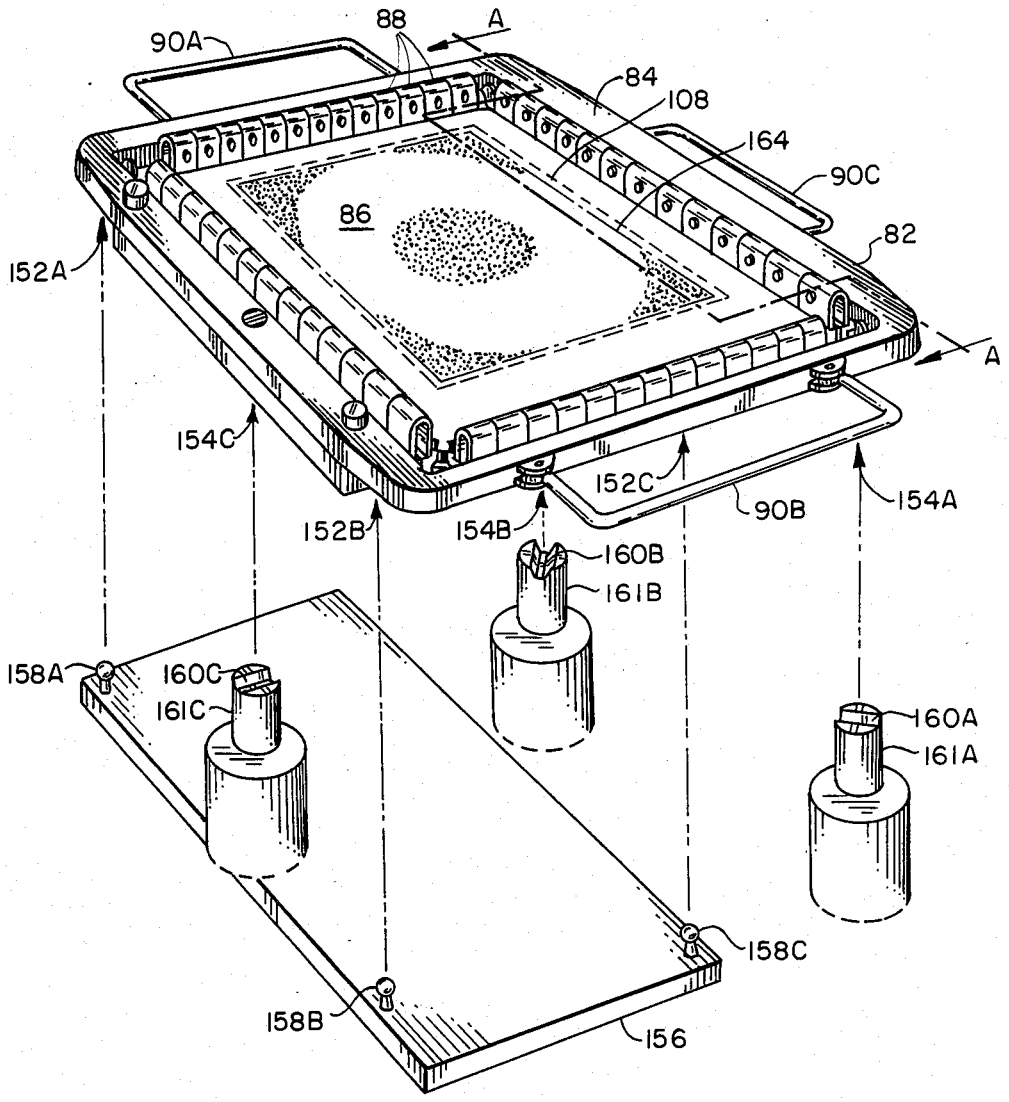
FIG. 10 is a view in perspective that depicts diagrammatically the means for mounting and registering the factory fixture frame according to the invention with means for mask welding and severing.

Factory fixture frame 82 has two sides of interest: first side 84, depicted in FIGS. 2, 6 and 10, and a second side 118, depicted in FIGS. 7 and 8. With reference to FIG. 8, first six-point indexing means on first side 84 provide for registration with complementary registration-affording means on an exposure lighthouse 122, and second six-point indexing means on an opposed second side 118 provide for registration with complementary registration-affording means on an in-process faceplate 120. As a result, in-process shadow mask 86 can be precisely registered and re-registered with lighthouse 122 and an in-process faceplate 120 while retaining the in-process shadow mask 86 in tension. The first six-point indexing means on the first side 84 also provide for registering the frame 82 and in-process shadow mask 86 with mask tensing and clamping means, noted as being machine 96, which has complementary six-point indexing means, as will be described.

The clamping means 88 for clamping and holding in-process mask 86 in tension is depicted in FIG. 6 as being in the form of a series of discrete spring clip means which provide for mechanically clamping the mask in tension. The spring clip means for clamping the in-process mask in tension are described and claimed in referent copending application Ser. No. 140,019 of common ownership herewith. The disclosure of application Ser. No. 140,019 is incorporated by reference herein. The factory fixture frame, while clamping the tensed in-process mask, is removed from the mask tensing-clamping machine 96 in readiness for subsequent photoexposure and screening operations, as will be described.

Photoexposure lighthouse 122 is illustrated schematically in FIG. 8 as comprising a base 124 within which is a light source 126 that emits ultraviolet radiation to which the various screening fluids are sensitized. The rays of the light source 126 typically pass through a correction lens and a neutral density filter (not shown) before reaching the shadow mask. A table top 128 provides for mounting a platform 130 for receiving factory fixture frame 82.

The six-point indexing means is depicted by way of example as comprising ball-and-groove means located on the parts to be registered. Although ball-and-groove indexing means are depicted for this means of indexing in this, and in subsequent depictions, it is noted that other means of indexing may as well be used.

With reference to the first side 84 of factory fixture frame 82, three groove means 132A, 132B and 132C are shown; these groove means provide for registration with three ball means 134A, 134B and 134C located on platform 130 of lighthouse 122. As indicated by FIG. 8, the factory fixture frame 82 according to the invention is lowered into registration with the lighthouse 122 for exposing the screening surface of in-process faceplate 120 to radiation from light source 126.

Figure 9:
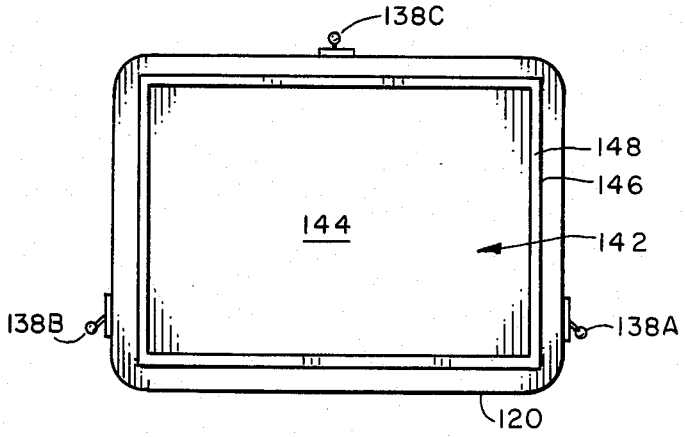
FIG. 9 is a plan view of an in-process faceplate showing the screening area, a shadow mask support, and indexing means extending from the sides thereof.

Groove means 132A, 132B and 132C also provide for the registration of factory fixture frame 82 with the mask tensing-clamping machine 96 in conjunction with six-point indexing means 135A, 135B and 135C, depicted in FIG. 3 as being in the form of ball means projecting from the lower platform 137 of machine 96. (Ball means 135C is not visible in FIG. 3.) Factory fixture frame 82 according to the invention is noted as having on its second side 118, second six-point indexing means for registering with complementary registration-affording means on the in-process faceplate 120. The indexing means are indicated as comprising ball-and-groove means located on the parts to be registered. With reference to the second side 118 depicted in FIG. 7, three groove means 136A, 136B and 136C are depicted; these groove means provide for registration with three balls means 138A, 138B and 138C extending from the sides of faceplate 120, as depicted in FIG. 9. The ball means 38A, 138B and 138C comprise temporary indexing means. The cement used for attachment of the temporary indexing means is of the type that becomes non-adherent at the frit cycle temperature of 435 degrees C. As a result, the ball means fall away from the faceplate at the time of final assembly. This concept of temporary attachment of the indexing balls to the faceplate, and the means therefore, is described and claimed in referent copending application Ser. No. 131,968 of common ownership. It will be observed that at least one of the sides of the factory fixture frame according to the invention has at least first and second six-point indexing means azimuthally rotated with respect to each other for indexed mating with complementary six-point indexing means on manufacturing machinery, with the manufacturing machinery noted as being a lighthouse in this phase of the process.

Plastic guides 140, indicated as being eight in number, provide for guiding in-process faceplate 120 into recess 141 of factory fixture frame 82, with the final, precision registration being provided by grooves 136A, 136B and 136C in registery with ball means 138A, 138B and 138C that extend from in-process faceplate 120.

In-process faceplate 120 has on its inner surface 142 a screening area 144 for receiving discrete deposits of phosphors. A shadow mask support structure 146 has surface 148 for receiving and securing in-process shadow mask 98 in tension by means to be described. The photoscreening process then follows. The inner surface 142 of the in-process faceplate 120, noted as being the screening surface, is first coated with a light-sensitive material. With reference to FIG. 8, the factory fixture frame 82 according to the invention, with the in-process shadow mask mounted in tension therein, is installed on the platform 130 of lighthouse 122, with precise registration of the first side 84 of frame 82 being provided by groove means 132A-C in conjunction with ball means 134A-C, which are located on lighthouse platform 130. The in-process faceplate 120 is in turn mounted on the factory fixture frame in precise registration with the captivated mask using groove means 136A-C on the second side 118 of frame 82 in conjunction with ball means 138A-C that extend from the sides of faceplate 120.

The screening surface 142 of faceplate 120 is exposed to light actinic to the coating through each of the apertures in the in-process mask 86. Faceplate 120 is then removed from lighthouse 122 to "develop" the coating. As a result of the preceding steps, a "grille" is formed on the screening surface 142 which has three open areas in correlation to each apertures of the shadow mask. The openings provide for receiving sequential deposits of red-light-emitting, green-light-emitting and blue-light-emitting phosphors. The faceplate is coated with a slurry containing phosphor which may comprise, by way of example, a phosphor that emits red light when excited by an electron beam. The faceplate is replaced in the lighthouse in precise registration with the in-process shadow mask, and the coating is exposed to light projected through the apertures of the mask from a light source located at a position that corresponds to the emission point of the particular electron beam that is intended to excite the red-light-emitting phosphor. The light, in effect, "hardens" the phosphor so that it will remain in place during a subsequent washing process.

The foregoing steps are repeated in turn to deposit the green-light-emitting phosphor and the blue-light-emitting phosphor in the respective openings in the grille. At least four such engagements and disengagements of the mask are required in the screening process. The final product is a faceplate having on its screening area 144 a pattern of groups of dots or lines capable of emitting upon excitation by electron beams red, green or blue light; this area comprises the screen 145. It is to be noted that, in this process, an in-process shadow mask is typically "mated" with an in-process faceplate; that is, the same mask is used in the photoscreening of a particular faceplate, and is permanently installed in conjunction with the faceplate in final assembly.

Upon completion of the photoscreening process, the inprocess shadow mask 86 is affixed to the mask-receiving surface 148 of the shadow mask support structure 146, and the mask 86 is removed from the factory fixture frame 82. The securement of the mask relative to the faceplate, and removal from the factory fixture frame, is preferably accomplished by the apparatus and process fully described and claimed in referent copending application Ser. No. 58,095, of common ownership herewith. The apparatus and process however is described in the following paragraphs in some detail in connection with FIGS. 7, 10 and 11 to facilitate a fuller understanding of the form and function of the factory fixture frame according to the invention.

With reference to FIG. 7, the second side 118 of factory fixture frame 82 is depicted as having third six-point indexing means 152A, 152B and 152C, depicted as being in the form of radially oriented grooves. Second side 118 is also depicted as having fourth six-point indexing means 154A, 154B and 154C, depicted as being in the form of ball means projecting from frame 82. Third and fourth six-point indexing means provide for gross and fine registration, respectively, of factory fixture frame according to the invention and an in-process mask with assembly means for affixing the mask to mask-support means extending from and secured to the faceplate, as will be shown and described.

With reference now to FIG. 10, there is indicated diagrammatically a receiving fixture 156 which is a part of a mask welding and severing machine (not shown). The machine includes a carousel which rotates to four stations in the process of welding an in-process shadow mask held in tension in the factory fixture frame to a mask support structure, and severing the resulting mask-faceplate assembly from the frame. In consequence of this process, the factory fixture frame is released for the temporary installation of a new in-process mask, and the faceplate assembly is released for attachment to a funnel.

Receiving fixture 156 is indicated as having three indexing means 158A, 158B and 158C represented as being in the form of ball means extending upwardly from fixture 156. Indexing means 158A, 158B and 158C provide for indexing with complementary six-point third indexing means 152A, 152B and 152C located on the second side 118 of factory fixture frame 82 (see FIG. 7); indexing means 152A, 152B and 152C are indicated as being in the form of radially oriented grooves. These indexing means provide for the gross registration of the factory fixture frame 82 and the enclosed in-process shadow mask 86 with the mask welding and tensing machine. Installation of the frame 82 on receiving fixture 156 is accomplished manually by means of the handles 90A, 90B and 90C.

The precise configuration of the shadow mask receiving surface 148 in relation to the ball means 138A-C of the in-process faceplate 120 is mapped by optical means in the second station (not shown) of the mask welding and severing machine. The receiving fixture 156, with the factory fixture frame 82 mounted thereon, is then rotated to a third station of the mask welding and severing machine along with the in-process faceplate 120. At this third station, fine registration means are brought into play to ensure exact and precise registration of the clamped-in mask with in-process faceplate 120, and to present the mask receiving surface 148 in a precise relative relationship in order to utilize the above-described mapping information to effectively drive the welding head at the mask welding and severing machine.

With reference again to FIG. 7, the fourth "fine" registration means comprise six-point indexing means 154A, 154B and 154C, depicted as comprising three ball means extending from the second side 118 factory fixture frame 82. Complementary to six-point indexing ball means 154A, 154B and 154C are the associated six-point indexing means 100A, 160B and 160C, indicated in FIG. 10 as comprising groove means located atop respective ram heads 161A, 161B and 161C, all three of which are mounted on a platform and raised and lowered in synchronism by a pneumatic piston (the platform and piston are not shown). As indicated by the associated arrows, ram heads 161A, 161B and 161C are caused to rise up to cause groove means 160A, 160B and 160C to engage respective the six-point indexing ball means 154A, 154B and 154C, located on second side 118 of the frame 82, and lift factory fixture frame 82 in precise, alignment with the drive reference of the laser beam that is used to weld the in-process mask 86 to mask support structure 146. In effect, factory fixture frame 82 has two related sets of sixpoint indexing means: The first of the sets provides for transporting frame 82 into a gross position relative to an operation utilizing the in-process mask, noted as being a laser mask welding and severing operation. The second of the sets provides for positioning of the factory fixture frame 82 in the welding and severing operation such that when the in-process faceplate 120 is brought into registry with the frame through the conjunction of ball means 138A-C on the faceplate with the groove means 136A-C on the frame, the faceplate is so located that the welding head can "find" the mask mounting surface 148 according to the stored mapping information obtained in the mapping station. In addition, as in lighthouse exposure processing, mating of the faceplate ball means 138A-C with the groove means 136A-C on the factory fixture frame assures precise registry at the screen 145 with the center field of apertures 104 of the clamped mask during the welding and severing operation.

With reference again to FIG. 7, ball means 154A, 154B and 154C also provide for precise registration of the factory fixture frame 82 with a frame carrier 83, and hence precise positioning and mounting of the in-process shadow mask in the factory fixture frame according to the invention.

Figure 11A:
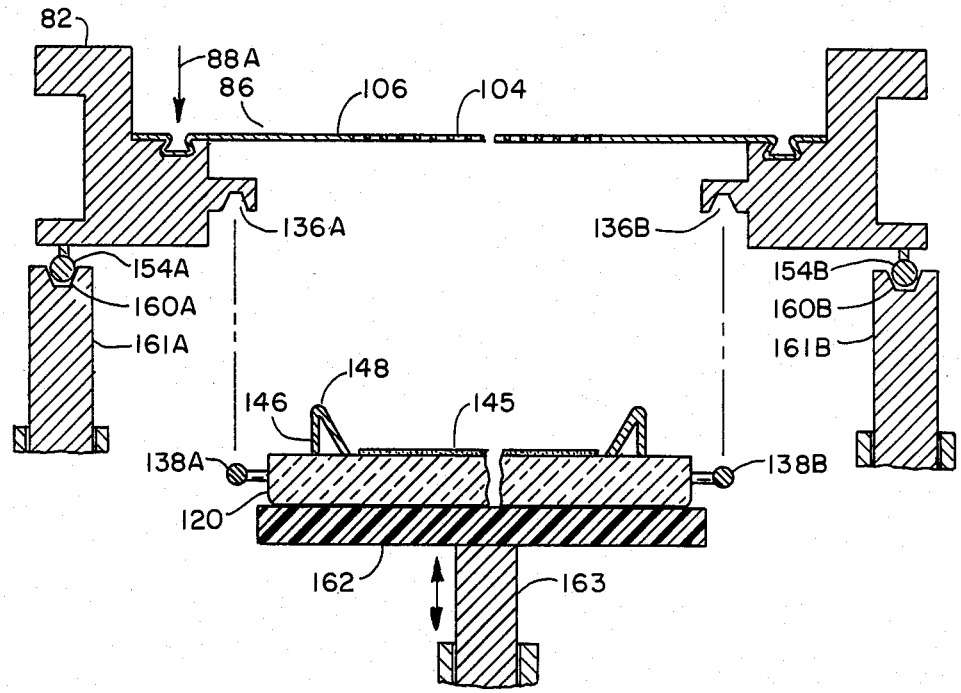
FIGS. 11A and 11B are sectional views in elevation taken along lines A—A of FIG. 10, and showing the sequence of precision registration of the factory fixture frame according to the invention with means for mask welding and severing.
Figure 11B:
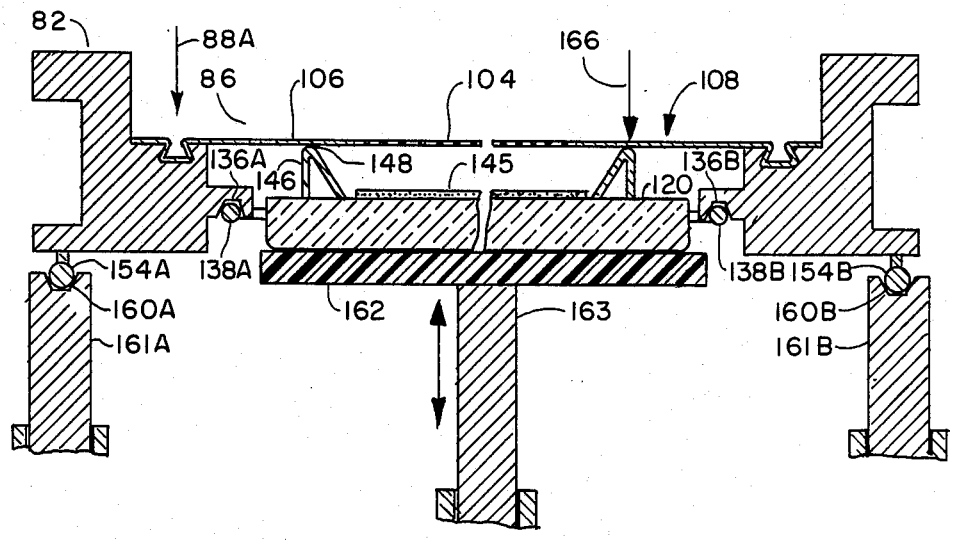

The function of the second of the sets of six-point indexing means for assuring absolute accuracy is depicted highly schematically in FIGS. 11A and 11B. Ram heads 161A and 161B (in conjunction with ram head 161C which is not shown) are indicated as having lifted factory fixture frame 82 from the gross position wherein the frame 82 was resting on ball means 158A, 158B and 158C of receiving fixture 156 by the conjunction of the ball means with groove means 152A, 152B and 152C. The clamping of mask 86 in frame 82 is indicated schematically by arrow 88A. Faceplate 120 is depicted as resting on carriage 162, indicated symbolically as being made of a plastic. A plastic softer than the glass of the faceplate is preferred as a carrier as it will not scratch or otherwise abrade the polished surface of the faceplate.

As indicated by the associated arrow, carriage 162 can be raised and lowered by the pneumatic piston 163, depicted in figure 11A as being in the lowered position.

FIG. 11B depicts in-process faceplate 120 as having been lifted by piston 163 into exact registration with factory fixture frame 82 and with the in-process shadow mask 86 contained therein. The means of registration of the in-process faceplate with the factory fixture frame are indicated as comprising the conjunction of ball means 138A, 138B (and 138C, not shown) that extend from faceplate 120 with groove means 136A, 136B (and 136C, not shown) that extend inwardly from factory fixture frame 82. The mask-receiving surface 148 of shadow mask support structure 146 is indicated in FIG. 11B as being in intimate, uniform contact with the shadow mask 86. The mask 86 could as well be in a negative interference relationship with the mask-receiving surface 148 mask support structure 146, an inventive concept that is described and claimed in referent copending application Ser. No. 60,135, of common ownership herewith.

According to the aforementioned 58,095 disclosure, the in-process mask 86, still clamped in tension in the factory fixture frame 82, is welded to mask receiving surface 148 of the shadow mask support structure 146; the weld line 164 is indicated in FIGS. 4 and 10. Welding is preferably accomplished with the beam of a carbon dioxide laser. The welding process is indicated schematically in FIG. 11B by arrow 166 which represents the laser beam. Upon completion of the welding, the power of the beam is reduced and the frame 106 of unperforated metal of in-process shadow mask 86 is severed at trim line 108, indicated by the arrow; the trim line 108 is also indicated in FIGS. 4 and 10.

Upon completion of the severing operation, the in-process shadow mask, now secured to mask support structure 146, is free of the factory fixture frame 82, and the assembly has become a viable faceplate assembly complete with a phosphor-bearing screen 145, and ready for attachment to a funnel. The attachment of a faceplate assembly to a funnel is depicted in FIG. 1.

The factory fixture frame 82 is reinstalled in the mask tensing-clamping machine 96, and the remainder of the mask 86 that is still clamped in the frame 82; that is, the frame 106 of unperforated metal, is removed from the frame, and a new in-process mask is tensed and clamped in the frame. The cycle of faceplate photoscreening, and mask welding and severing, is then repeated.

The process according to the invention for use in the manufacture of a color cathode ray tube having a flat faceplate and a tensed foil shadow mask comprises the following— providing a reusable, generally rectangular factory fixture frame having quick-release mechanical mask-retaining means;

temporarily and removably supporting an in-process shadow mask in tension on the frame by the mechanical mask-retaining means;

providing on a first side of the frame six-point indexing means and, using the indexing means, and registering the frame and the mask with a photoexposure lighthouse having complementary six-point indexing means;

providing on a second, opposed side of the frame six-point indexing means, and registering the frame and the mask with means for affixing the mask to a mask-supporting structure on the faceplate;

affixing the mask to the mask-supporting structure; and severing the combined mask and faceplate assembly from the frame thereby releasing the frame for reuse.

Additionally and in accord with the inventive process, third and fourth six-point indexing means are provided on the second side 118 of factory fixture frame 82 for gross and fine registration, respectively, of the frame 82 according to the invention, and the in-process mask 86, with complementary sixpoint indexing means on the mask welding and severing machine. It is essential that the material of which the factory fixture frame is made provide a structure that is reusable, rigid in construction, and yet relatively light in weight for easy handling. A preferred material is cast stainless steel which provides the necessary rigidity and corrosion resistance. The lightness of the factory fixture frame according to the invention is due to its construction, in that it is cast in the form of thin main members supported by numerous gussets. The factory fixture frame is made resuable by virtue of the fact that the frame 106 of unperforated metal of the in-process shadow mask is not permanently secured to the factory fixture frame by means such as welding, but instead, by quick-release mechanical means according to the invention. Components of the six-point indexing means such as groove means and ball means are necessarily hardened to limit the effects of physical wear and the trauma of physical shock an impact inherent in the positioning and retrieving of the frame by hand during production.

While a particular embodiment of the invention has been shown and described, it will be readily apparent to those skilled in the art that changes and modifications may be made in the inventive means and process without departing from the invention in its broader aspects, and therefore, the aim of the appended claims is to cover all such changes and modifications as fall within the true spirit and scope of the invention.

What is claimed is:

1. For use in the manufacture of a color cathode ray tube having a flat faceplate and a tensed foil shadow mask, a reusable factory fixture frame for mounting an in-process shadow mask during photoexposure of an in-process faceplate in a lighthouse, said frame comprising generally rectangular frame means and quick-release mechanical mask-retaining means for temporarily and removably supporting an in-process shadow mask in tension, said frame having first six-point indexing means on a first side for registration with complementary registration-affording means on an exposure lighthouse, and second six-point indexing means on a second, opposed side for registration with complementary registration-affording means on said in-process faceplate, whereby said in-process shadow mask can be precisely registered and re-registered with said lighthouse and said in-process faceplate for the photoexposure of said in-process faceplate while retaining said in-process shadow mask in tension.

2. The factory fixture frame according to claim 1 wherein said first six-point indexing means on said first side also provides for registering said frame and said in-process mask with mask tensing and clamping means having complementary six-point indexing means.

3. The factory fixture frame according to claim 1 including third and fourth six-point indexing means on said second side for gross and fine registration, respectively, of said frame and said in-process mask with assembly means for affixing said mask to mask-support means extending from said faceplate, said assembly means including complementary six-point indexing means for each of said third and fourth six-point indexing means of said factory fixture frame.

4. The factory fixture frame according to claim 1 wherein said quick-release mechanical mask-retaining means of said factory fixture frame provides for the cementless and weldless quick-retention and release of said in-process shadow mask.

5. The factory fixture frame according to claim 1 wherein said quick-release mechanical mask-retaining means of said factory fixture frame provides for the retention of said in-process mask out of the plane of said mask.

6. For use in the manufacture of a color cathode ray tube having a flat faceplate and a tensed foil shadow mask, a reusable factory fixture frame for mounting an in-process shadow mask during photoexposure of an in-process faceplate in a lighthouse, said frame comprising generally rectangular frame means and quick-release mechanical mask-retaining means for temporarily and removably supporting an in-process shadow mask in tension out of the plane of said mask, and providing for quick cementless and weldless retention and release of said mask, said frame having first six-point indexing means on a first side for registration with complementary registration-affording means on an exposure lighthouse, and second six-point indexing means on a second side for registration with complementary registration-affording means on both said whereby said in-process mask can be precisely registered and reregistered with said lighthouse and said in-process faceplate for the photoexposure of said in-process faceplate while retaining said in-process mask in tension, and whereby said frame and said in-process mask can be registered with said mask tensing and clamping means.

7. The factory fixture frame according to claim 6 including third and fourth six-point indexing means on said second side for the gross and fine registration, respectively, of said frame and said in-process mask with assembly means for affixing said mask to mask-support means secured to said faceplate, said assembly means including complementary six-point indexing means for each of said third and fourth six-point indexing means of said factory fixture frame.

8. For use in the manufacture of a color cathode ray tube having a flat faceplate and a tensed foil shadow mask, a reusable factory fixture frame for temporarily mounting and conveying an in-process shadow mask for processing by manufacturing machinery, said frame comprising a generally rectangular frame means having a first side and an opposed second side, at least one of said sides having at least first and second six-point indexing means azimuthally rotated with respect to each other for indexed mating with complementary six-point indexing means on said manufacturing machinery.

9. For use in the manufacture of a color cathode ray tube having a flat faceplate and a tensed foil shadow mask, a reusable factory fixture frame for temporarily mounting and conveying an in-process shadow mask for processing by manufacturing machinery, said frame comprising generally rectangular frame means having six-point indexing means on a first side for indexed mating first with complementary six-point indexing means located on means for mask tensing and clamping, and subsequently with indexing means located on a lighthouse, and six-point indexing means on a second, opposed side for indexed mating with complementary six-point indexing means on an in-process faceplate.

10. For use in the manufacture of a color cathode ray tube having a flat faceplate and a tensed foil shadow mask, a reusable factory fixture frame for mounting an in-process shadow mask, said frame comprising generally rectangular frame means and quick-release mechanical mask-retaining means for temporarily and removably supporting an in-process shadow mask in tension, said frame having two related sets of six-point indexing means, the first of said sets providing for transporting said frame into a gross position relative to an operation utilizing said mask, with the second of said sets providing for assuring absolute accuracy in positioning said frame during said operation utilizing said mask.

11. A process for use in the manufacture of a color cathode ray tube having a flat faceplate and a tensed foil shadow mask, the process comprising:

providing a reusable, generally rectangular factory fixture frame having quick-release mechanical mask-retaining means;

temporarily and removably supporting an in-process shadow mask in tension on said frame by said mechanical mask-retaining means;

providing on a first side of said frame six-point indexing means and, using said indexing means, registering said frame and said mask with a photoexposure lighthouse having complementary six-point indexing means;

providing on a second, opposed side of said frame sixpoint indexing means, and registering said frame and said mask with means for affixing said mask to a mask-supporting structure on said faceplate;

affixing said mask to said mask-supporting structure; and severing the combined mask and faceplate assembly from said frame thereby releasing said frame for reuse.

12. A process for use in the manufacture of a color cathode ray tube having a flat faceplate and a tensed foil shadow mask, comprising:

providing a reusable, generally rectangular factory fixture frame having quick-release mechanical mask-retaining means;

temporarily and removably supporting an in-process shadow mask in tension on said frame with said mechanical mask-retaining means;

providing a faceplate having indexing means extending from the side thereof for registration with indexing means extending internally from said factory fixture frame;

providing a shadow-mask-supporting structure and securing said structure to the screen-bearing surface of said faceplate on opposed sides of the screen;

affixing said in-process shadow mask in tension to said supporting structure; and severing the combined mask-faceplate assembly from said frame thereby releasing said frame for reuse.

* * * * *